United States Patent [19]

Manley, Jr.

[11] 4,069,679

[45] Jan. 24, 1978

[54] UNDERSEA PLOW

[75] Inventor: Robert B. Manley, Jr., Tulsa, Okla.

[73] Assignee: Standard Oil Company, Chicago, Ill.

[21] Appl. No.: 735,880

[22] Filed: Oct. 27, 1976

[51] Int. Cl.[2] ..... F16L 1/00; E02F 5/02

[52] U.S. Cl. ..... 61/72.4; 61/72.6

[58] Field of Search ..... 61/72.4, 72.6; 37/58, 37/86, 87, 64, 65, 193, DIG. 18; 172/699

[56] References Cited

U.S. PATENT DOCUMENTS

| | | | |
|---|---|---|---|
| 1,100,920 | 6/1914 | Seay | 172/699 |
| 2,067,717 | 1/1937 | Lawton et al. | 61/72.6 X |
| 2,144,063 | 1/1939 | Irvin | 61/72.4 |
| 3,347,054 | 10/1967 | Sherrod | 61/72.4 |
| 3,462,963 | 8/1969 | Moore | 61/72.4 |
| 3,699,693 | 10/1972 | Nelkin et al. | 61/72.6 |
| 3,788,085 | 1/1974 | Holberg | 61/72.4 |
| 3,824,798 | 7/1974 | Shiroyama et al. | 61/72.6 X |
| 3,898,852 | 8/1975 | Ezoe et al. | 61/72.6 X |

FOREIGN PATENT DOCUMENTS

| | | | |
|---|---|---|---|
| 2,256,178 | 5/1974 | Germany | 37/193 |

*Primary Examiner*—Dennis L. Taylor
*Attorney, Agent, or Firm*—John D. Gassett

[57] ABSTRACT

An undersea plow is towed by a surface vessel to inscribe a pattern of marks on a marine bottom of questionable soil stability. The plow digs a trench large enough to be seen by sidescan sonar but does not bury itself so far in the soft soil that it cannot be towed at a reasonable rate. The plow is symmetrical about a horizontal line parallel to the path of the trench so that regardless of how the plow comes to rest when lowered, it will still dig the trench. Periodic sidescan surveys detect bottom soil movements by mapping changes in the pattern of marks created by the plow.

5 Claims, 5 Drawing Figures

UNDERSEA PLOW

BACKGROUND OF THE INVENTION

This invention relates generally to the study of soil stability on the bottom of a body of water and, more particularly, to a tool for inscribing a pattern of marks, subsequent surveying of which reveals any changes in the pattern caused by shifting soil.

Soil studies are frequently made where the stability of the sea floor is questionable. Such studies are required in connection with a variety of marine activities. Conventional offshore oil and gas production operations utilize structures resting on the sea floor held in place by piles driven into the floor. The site selection and design of these structures and piles must take into account the characteristics of the soil. Underwater pipeline emplacement requires a knowledge of the terrain to be traversed. Sea bottom vehicles for pipeline and cable burying or scientific purposes require a certain soil strength to support them, especially if the vehicle is self-propelled.

PRIOR ART

No device has been found in the prior art whose single purpose is to dig a trench on the sea floor. Consequently, prior undersea plowing devices include complicated and costly features such as rotary cutters, high-pressure field jet cutters, depth variation mechanisms and pipe or cable burying apparatus. Examples of prior plows are shown in U.S. Pat. Nos. 3,347,054, Shenod and 3,462,963, Moore. Both of these plows have blades for cutting a trench and means for guiding the blade as it is towed through the soil. They also have means for varying the depth of cut and for laying a pipeline in the trench. More 963 provides pivot connections 202 and 222 between the guiding skid 10 and plow 14 to allow the plow to ride up over obstructions. It also uses fluid jet cutters.

PRESENT INVENTION

The components of the plow of my invention are all rigidly connected and the only cutting action is provided by the forward motion of the plow blade. These simplifying features are possible because the plow will only be used in areas of questionable soil stability. Only soft soil will be encountered. The single purpose plow is meant only to dig a trench. Previous devices are overdesigned for this criteria.

SUMMARY OF THE INVENTION

This invention relates to a plow for digging a trench on the floor of a body of water. A pattern of trenches is dug on the sea floor as an aid in the study of soil stability. The plow comprises three basic components. An excavating section performs the actual digging and lifting of soil out of the trench. A leading pilot section acts like a skid, sliding along the ground at the front of the plow to keep the plow at the proper angle for cutting. This part also prevents nosediving or burying of the plow. The third component is a set of rigid connection beams between the leading and digging ends. The components are so arranged as to be symmetrical about a line horizontal to the sea floor and parallel to the trench.

It is an object of this invention to provide a simple, efficient plow for digging trenches in soft sea floor soil.

This plow can be easily constructed from inexpensive materials. The plow itself has no moving parts.

It is a further object of this invention to provide an undersea plow which will be functional regardless of how it comes to rest upon lowering. When towing begins, the plow will right itself to a position where it will dig the trench as designed.

The plow disclosed in the present invention is a useful tool for a new method of stability study. It digs trenches to form grid marks whose location is mapped by sonar survey. The survey is repeated at a later date to map the now configuration of the grid marks. Changes in the grid indicate large movements. Small displacements in individual lines indicate creep motion. Effacement of the lines by advancing mud flows should be apparent as well.

DETAILED DESCRIPTION OF THE INVENTION

Figure 1:
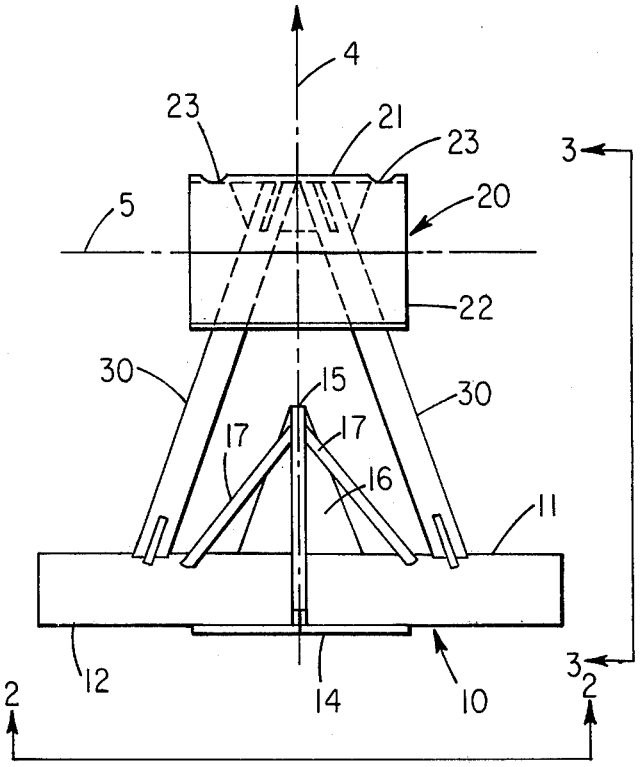
FIG. 1 is a plan view of the plow.

Referring now to FIG. 1, a preferred embodiment of the plow is shown. The arrow indicates the direction in which the plow is towed. Excavation means are generally indicated at 10. At the leading end of the plow is the pilot means 20. Connecting these sections are connecting members 30. The following description of these components refers to FIGS. 1, 2, and 3, common numbers indicating identical parts in each figure.

The excavation means 10 includes a soil spreader 11, a blade 14, and a blade stabilizer 15. There are also small gusset plates 16 and braces 17 providing support for the main pieces.

The soil spreader 11 is a semi-cylinder whose axis is along an imaginary line 1. This line is horizontal and perpendicular to the direction of tow. When in operation, then, the soil spreader rests across the top of the trench providing support for the excavation means. The convex side of the spreader faces the front of the plow so the nearfacing edges of the semi-cylinder define first and second coplanar, vertical faces 12 and 12A.

The blade 14 of the plow is attached to the faces 12 of the soil spreader. The blade is shown as a hexagonal-shaped plate with an elongated vertical dimension such that the blade is about as high as the soil spreader is wide. Also, the blade width typically is about twofifths of the soil spreader width. The blade 14 is attached to the soil spreader 11 at a point where the vertical midline, shown by imaginary line 2, of the blade bisects the width of the spreader. In addition, the horizontal midline, shown by imaginary line 1, is colinear with the axis of the spreader. Strictly speaking, of course, the horizontal midline of the blade would run through the middle of the thickness of the blade and would not be colinear with the spreader axis; it would be removed by the distance of half the blade thickness. But the horizontal midline, or bisector, on the forward face of the blade is colinear with the spreader axis, and it is this line to which the term horizontal midline refers. Similarly, considering the vertical midline to be on the front face of the blade, the two midlines intersect at a center point 3. It can be seen, then, that a line through center point 3 and perpendicular to both midlines 1 and 2 (and, therefore, perpendicular to the blade) defines a line of symmetry 4 about which the combination of blade 14 and soil spreader 11 is symmetrical.

The blade stabilizer 15 is a generally rectangular plate attached to the front face of the blade 14 along the vertical midline 2, perpendicular to both the blade and spreader. Obviously, the stabilizer 15 has a semi-circular portion cut out at the middle of the trailing edge where the soil spreader 11 fits through the stabilizer. The stabilizer height is slightly less than that of the blade, while the width of the stabilizer is about equal to the width of the blade. The stabilizer is centered so that the line of symmetry 4 is the horizontal bisector of the stabilizer, running through the center of the stabilizer thickness. Since the gusset plates 16 and braces 17 are also symmetric about line 4, the whole excavation means is symmetric about that line.

Figure 3:
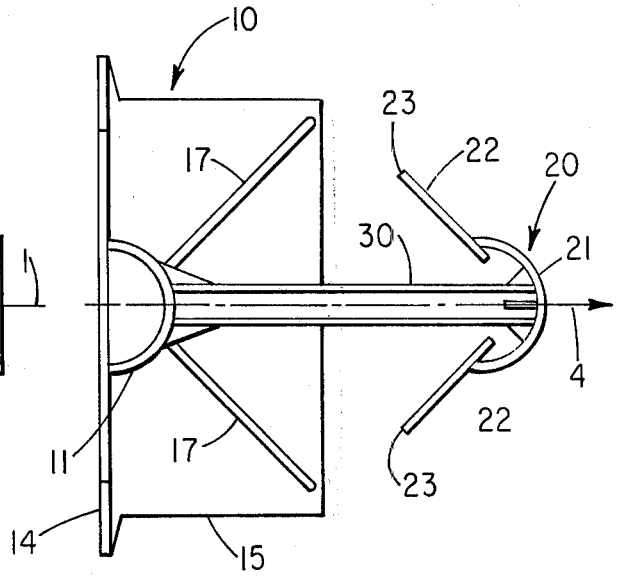
FIG. 3 is side elevation view of the plow taken along line 3—3 of FIGS. 1.
Figure 5:
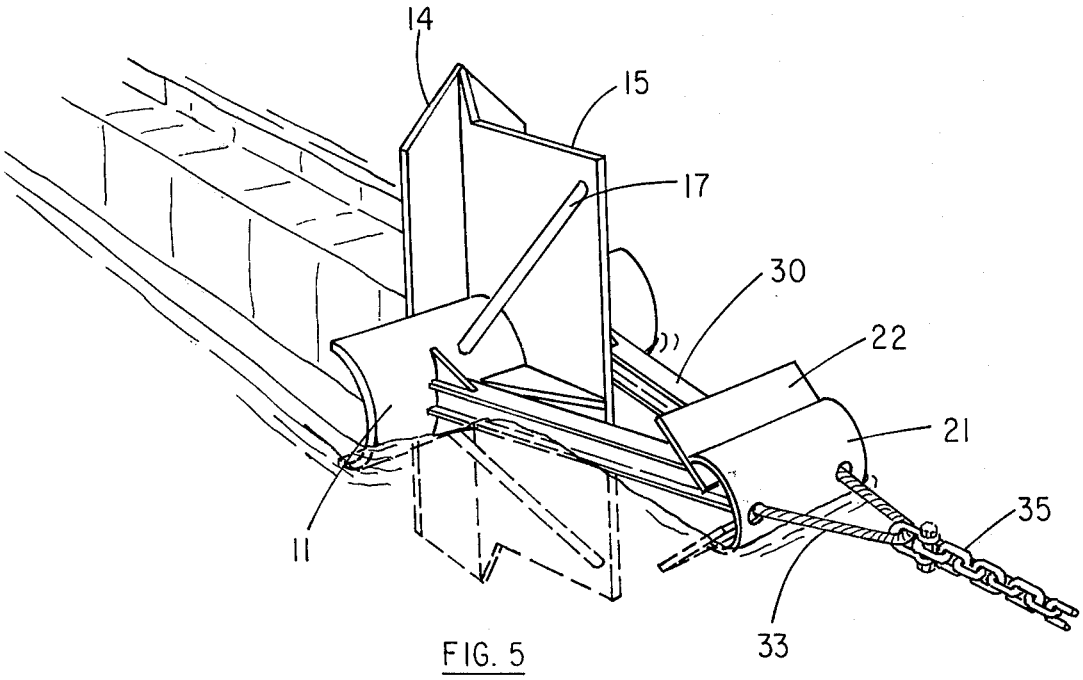
FIG. 5 is an isometric view of the plow and the trench it creates.

Pilot means 20 is located at the front of the plow. As best seen in FIG. 3, it comprises a nose 21 and two fins 22. The nose is a semi-cylinder of radius preferably equal to that of the spreader and width equal to that of the blade. Its convex side faces forward. Two holes 23 are provided for attachment of the pilot means harness 33 and the towing chain 35 as shown in FIG. 5. The axis of the nose 21 is along imaginary line 5. The axes of both the spreader 11 and nose 21 are horizontal and perpendicular to the line of symmetry 4. Fins 22 are rectangular plates of width preferably equal to that of the nose 21. They are rigidly attached to the edges of the nose. Each fin is swept back from the front of the nose. This means that the trailing edges 23 of the fins 22 are tilted away from the nose 21 so that the angle between a vertical line and the fins 22 is about 30–40°.

The connecting members 30 of the preferred embodiment are [w6×12] beams. At the forward ends of the beams, they are rigidly attached to the concave side of nose 21. The ends of the beams are directly adjacent at the middle of the nose. The trailing ends of the beams are rigidly attached to the spreader 11, spaced apart by a distance somewhat greater than the width of the blade. Extra support plates are provided at both the forward and trailing points of attachment. As seen in FIG. 3, the beams lie in a horizontal plane. FIG. 1 shows the layout of the beams forms a V-shape. The bisector of the V is the line of symmetry 4. From this, it can be seen that the entire plow is symmetrical about the line.

Figure 4:
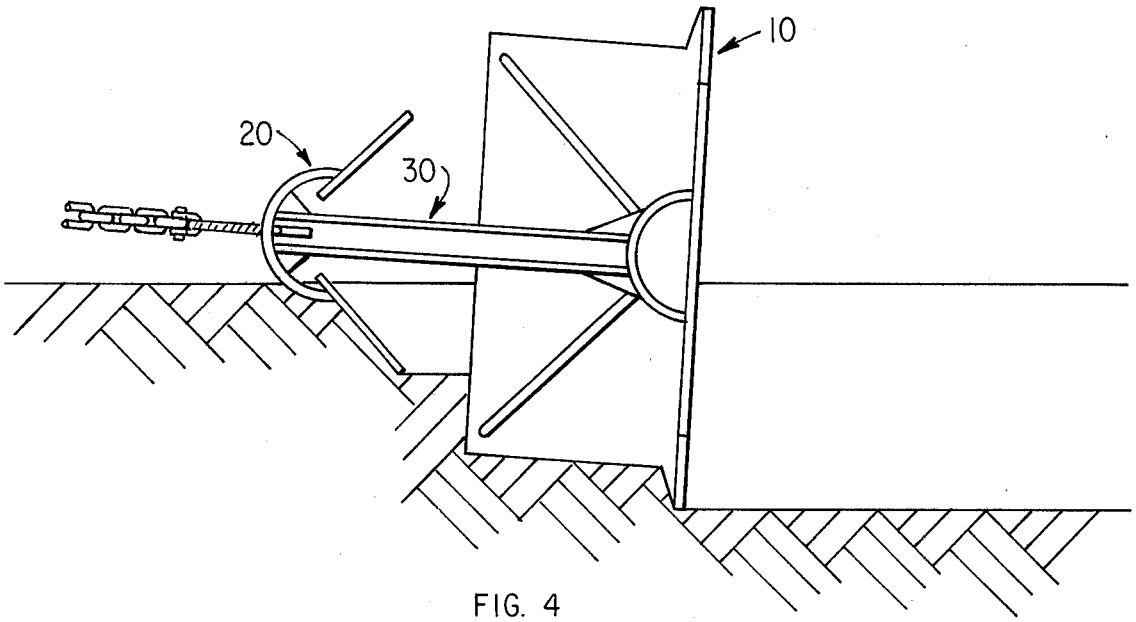
FIG. 4 is a side elevation of the plow as it is towed through the sea floor soil.

When in operation, the plow is towed along the sea floor by a surface vessel. In one plow, which was built and used, a shot of chain, e.g., 90', is connected to a harness 33 which is attached through holes 23. Harness 33 is attached to chain 35 which extends about 93 feet ahead of the plow on the floor. The weight of this chain, along with the weight of the pilot means 20, keeps the pilot means 20 engaged with the floor. Otherwise, the pilot means 20 might be pulled up off bottom, resulting in improper engagement of the blade with the soil and thus, a shallower ditch than desired. FIG. 4 shows a side view of the plow in operation. The pilot means 20 keeps the front of the plow up so it will not bury itself. Since the plow is rigid, this lifting action of the nose tilts the top of the excavation means backwards. The degree of tilt depends on how soft the soil is and how far the plow sinks in under its own weight. The cutting action is initiated by the blade stabilizer. Then the blade follows, pushing the soil forward. The pressure of this forward motion causes the soil to build up out of the path of the trench and the soil spreader forces it down and to the sides of the trench. As the spreader rides over the existing bottom and displaced soil, it acts to pack down the soil thereby preventing refilling of the trench.

A plow has been built and operated according to this embodiment The actual plow cut a trench four feet deep and four feet wide. The steel plate used was one inch thick and all joints were made with all-around full fillet welds.

Figure 2:
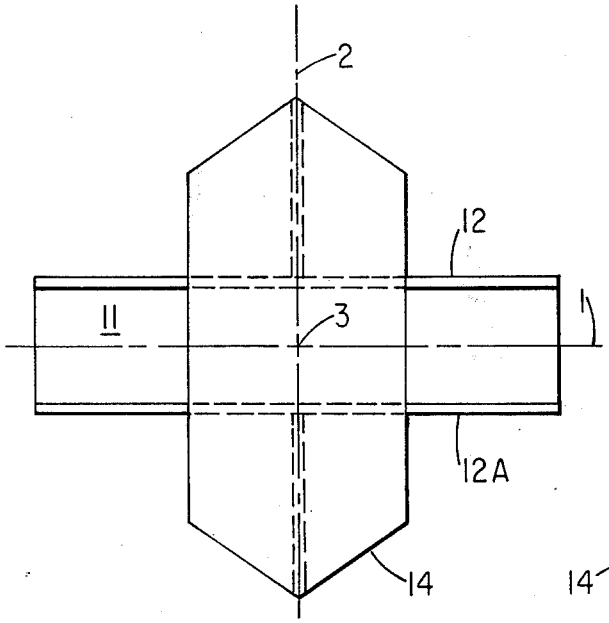
FIG. 2 is sea end elevation view of the plow taken along line 2—2 of FIG. 1.

A major advantage of this plow is the symmetrical design. This assures that the plow can be lowered to the sea floor at any angle and it will still dig the trench. The stabilizer operates such that should the blade and spreader rotate horizontally around the pilot means harness 33 (FIG. 5) during towing, the force exerted by the soil on the stabilizer would rotate the blade and spreader back into the proper towing orientation. FIG. 2 shows the blade can land at either end and still work. If the plow lands with the blade horizontal, the towing action will cause the pilot means to right the plow. This symmetrical design allows faster setup and, therefore, less costly trenching. Another advantage of the plow is the simple, inexpensive materials and construction.

It can be seen that other configurations of this plow are possible. The pilot means, for example, could be any streamlined shape that would ride up on the sea floor. Although the description here has been of an actual plow and, therefore, of some detail, this is not intended to limit the scope of the claimed invention. It is understood that other designs are possible without departing from the spirit or scope of the present invention.

I claim:

1. An undersea plow for digging a trench having a longitudinal axis by towing the plow by towing means along the floor of a body of water, comprising:

excavation means for cutting said trench, raising soil therefrom, and dispersing said soil away from said trench, said excavation means having a vertical plane which in operation is perpendicular to said longitudinal axis of said trench;

a rigid pilot means having at least a partially cylindrical surface for connecting to said towing means and spaced from said excavation means and positioned at the leading end of said plow for maintaining proper attitude of said excavation means; and at least one connecting member rigidly connecting said pilot means and said excavation means in a fixed position so that the axis of said cylindrical surface of said pilot means in operation is perpendicular to the vertical plane of said excavation means.

2. An undersea plow as recited in claim 1 wherein said excavation means includes:

an elongated soil spreader which when in operation lies horizontally on or near said floor of said body of water, transverse to and across the top of said trench and is rigidly attached to said connecting member;

a blade, rigidly attached to said soil spreader and perpendicular thereto, defining a vertical plane transverse to the path of said trench and, when in operation, extends beneath said floor to cut said trench;

a blade stabilizer, rigidly attached to said blade and said soil spreader and perpendicular to both, defining a vertical plane parallel to the path of said trench.

3. An undersea plow as recited in claim 1 wherein said pilot means is adapted to engage with and move slidably along said floor of said body of water, said pilot means having a streamlined shape which precludes burying of said pilot means thereby forcing said connecting member to maintain said excavation means in an angular relationship with said floor.

4. An undersea plow for digging a trench by towing the plow along the floor of a body of water, comprising:

a soil spreader which is a semi-cylinder with first and second coplanar, vertical faces at the edges of said semi-cylinder, the axis of which lies in a plane horizontal to said floor, transverse to the path of said trench;

a blade which has a planar, vertically-elongated hexagonal shape defining a plane transverse to the path of said trench, said blade also being about two-fifths as wide as said spreader and about as high as said spreader is wise, said blade being rigidly attached to said first and second vertical faces of said spreader at a point where the vertical midline of said blade bisects the width of said spreader and the horizontal midline of said blade is colinear with said axis of said spreader so that the combination of blade and spreader defines a symmetrical relationship about a horizontal line of symmetry through the center point of said blade and perpendicular thereto;

a blade stabilizer which is a vertical, rectangular plate of height about equal to that of said blade, having a trailing edge rigidly attached to said blade on the same side thereof as said spreader, with a semi-circular portion cut out at the middle of said trailing edge to accommodate fitting said stabilizer over said spreader, said stabilizer being attached along said vertical midline of said blade, perpendicular to both said blade and said spreader, thereby preserving said symmetrical relationship;

a pilot means including, a nose which is a semi-cylinder with a radius equal to that of said spreader, width about equal to that of said blade, and whose axis is horizontal and parallel to that of said spreader, there also being first and second faces at the edges of said semi-cylinder to which edges are attached;

fins which are rectangular, have a width equal to that of said nose and are arrayed in an angular relationship which defines planes that are each swept back from said semi-cylinder in a range of from about 30° to 40 ° from vertical;

two connecting members which are beams laid out in a plane horizontal to said floor, the forward ends of said beams placed directly adjacent to each other and are rigidly attached to the middle of the concave side of said nose, the opposite ends of said beams rigidly attached to the convex side of said spreader, said opposite ends separated by a distance slightly greater than the width of said nose, so that said beams have a V-shaped configuration in said horizontal plane and the bisector of said Vshape is parallel to the path of said trench, bisects the width of said nose, fins, and spreader and is colinear with said line of symmetry about which the entire plow is symmetrical.

5. An undersea plow as recited in claim 1 in which said rigid pilot means includes:

a nose which is a semicylinder having first and second faces at the edges of said cylinder; and fins which are rectangular and are attached to said edges and arrayed in an angular relationship which defines planes that are each set back from said semicylinder in a range of from about 30° to 40° from vertical.

* * * * *